US010399348B2

(12) United States Patent
Smith et al.

(10) Patent No.: US 10,399,348 B2
(45) Date of Patent: Sep. 3, 2019

(54) MODULE FOR INK JET PRINTER

(71) Applicant: VIDEOJET TECHNOLOGIES INC., Wood Dale, IL (US)

(72) Inventors: Robert Smith, Northamptonshire (GB); David Doswell, Huntingdon Cambridgeshire (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 15/736,669

(22) PCT Filed: Jun. 14, 2016

(86) PCT No.: PCT/US2016/037320
§ 371 (c)(1),
(2) Date: Dec. 14, 2017

(87) PCT Pub. No.: WO2016/205168
PCT Pub. Date: Dec. 22, 2016

(65) Prior Publication Data

US 2018/0354269 A1 Dec. 13, 2018

(30) Foreign Application Priority Data

Jun. 15, 2015 (GB) ..... 1510464.9

(51) Int. Cl.
*B41J 2/175* (2006.01)
*B41J 2/185* (2006.01)

(52) U.S. Cl.
CPC ..... *B41J 2/17523* (2013.01); *B41J 2/1752* (2013.01); *B41J 2/1753* (2013.01); (Continued)

(58) Field of Classification Search
CPC .. B41J 2/17523; B41J 2/1753; B41J 2/17546; B41J 2/17556; B41J 2/17563; (Continued)

(56) References Cited

U.S. PATENT DOCUMENTS 6,059,405 A * 5/2000 Mochizuki ..... B41J 2/17509 347/92
6,322,205 B1 11/2001 Childers
(Continued)

FOREIGN PATENT DOCUMENTS

EP 0940260 A1 9/1999
EP 1078769 A2 2/2001
(Continued)

OTHER PUBLICATIONS

PCT/US2016/037320 International Search Report and Written Opinion, dated Feb. 15, 2017, 24 pages.

*Primary Examiner* — Anh T Vo
(74) *Attorney, Agent, or Firm* — Beusse, Wolter, Sanks & Maire PLLC; Robert L. Wolter

(57) ABSTRACT

A removable module for an inkjet printer comprises: a housing; a plurality of fluid conduits; two cartridge connections; a printer connection; and an electrical link. The plurality of fluid conduits are disposed within the housing. The two cartridge connections are each for releasable engagement with a fluid cartridge. Each cartridge connection is exposed by the housing and comprises: a fluid connector for engaging an outlet of a fluid cartridge to allow fluid to flow from the engaged cartridge to one of the plurality of fluid conduits; and an electrical contact arranged to contact a corresponding contact on the engaged fluid cartridge. The printer connection is for releasable engagement with an inkjet printer.

20 Claims, 9 Drawing Sheets

(52) U.S. Cl.
CPC ..... *B41J 2/17546* (2013.01); *B41J 2/17556* (2013.01); *B41J 2/17563* (2013.01); *B41J 2/17566* (2013.01); *B41J 2/17596* (2013.01); *B41J 2/185* (2013.01); *B41J 2002/1853* (2013.01)

(58) Field of Classification Search
CPC .... B41J 2/17566; B41J 2/17596; B41J 2/185; B41J 2002/1853
See application file for complete search history.

(56) References Cited

U.S. PATENT DOCUMENTS

| | | | | |
|---|---|---|---|---|
| 6,428,152 | B1 * | 8/2002 | Hollands | B41J 2/17513 347/85 |
| 6,467,861 | B1 | 10/2002 | Thielman | |
| 6,481,836 | B1 | 11/2002 | Paroff | |
| 7,073,442 | B2 | 7/2006 | Fedor | |
| 7,549,739 | B2 * | 6/2009 | Iwata | B01D 19/0031 347/89 |
| 9,393,803 | B2 * | 7/2016 | Ando | B41J 2/19 |
| 2011/0199448 | A1 * | 8/2011 | Kaiho | B41J 11/002 347/102 |
| 2013/0229457 | A1 | 9/2013 | Yu | |
| 2015/0070415 | A1 * | 3/2015 | Ishikawa | B41J 2/175 347/6 |

FOREIGN PATENT DOCUMENTS

| | | | |
|---|---|---|---|
| JP | 2004070360 | A | 3/2004 |
| WO | 199419197 | A1 | 9/1994 |
| WO | 2002078958 | A1 | 10/2002 |
| WO | 2009049146 | A1 | 4/2009 |
| WO | 2014154830 | A1 | 10/2014 |
| WO | 2014200642 | A1 | 12/2014 |

* cited by examiner

MODULE FOR INK JET PRINTER

BACKGROUND

The present invention relates to ink jet printing and more particularly to a removable module for an ink jet printer such as a continuous ink jet printer.

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurized ink to a print head drop generator where a continuous stream of ink emanating from a nozzle is broken up into individual regular drops by, for example, an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix including a regular array of potential drop positions. Each matrix includes a plurality of columns (strokes), each being defined by a line including a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a sealed compartment of a cabinet that includes a separate compartment for control circuitry and a user interface panel. The system includes a main pump that draws the ink from a reservoir or tank via a filter and delivers it under pressure to the print head. As ink is consumed the reservoir is refilled as necessary from a replaceable ink cartridge that is releasably connected to the reservoir by a supply conduit. The ink is fed from the reservoir via a flexible delivery conduit to the print head. The unused ink drops captured by the gutter are recirculated to the reservoir via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. To compensate for this, "make-up" solvent is added to the ink as required from a replaceable ink cartridge so as to maintain the ink viscosity within desired limits. This solvent may also be used for flushing components of the print head, such as the nozzle and the gutter, in a cleaning cycle.

The ink and solvent cartridges are filled with a predetermined quantity of fluid and generally releasably connected to the reservoir of the ink supply system so that the reservoir can be intermittently topped-up by drawing ink and/or solvent from the cartridges as required. To ensure the cartridges are brought into correct registration with supply conduits, the cartridges are typically connected to the ink supply system via a docking station including a cartridge holder. When the cartridges are correctly docked fluid communication with an outlet port of the cartridge is ensured.

It is important from the manufacturer's perspective that the ink jet printer is consumes only ink (or solvent) of the correct type and quality. If a cartridge containing the wrong ink is used the printing quality can be compromised and, in extreme cases, printer failure may be caused. It is therefore known, in some inkjet printers, to provide the cartridge with an externally machine readable label (e.g. a bar code) carrying information regarding the fluid contained within the cartridge. The label is swiped past a reader associated with the control system of the printer before the cartridge is installed and only when the control system of the printer has read the information on the label and verified that the ink is suitable for operation with the printer does it allow ink or solvent to be drawn from the cartridge.

It is an object of the present invention, amongst others, to provide an improved or an alternative ink jet printer.

BRIEF SUMMARY

According to a first aspect of the present invention there is provided a removable module for an inkjet printer including: a housing; a plurality of fluid conduits disposed within the housing; two cartridge connections, each for releasable engagement with a fluid cartridge, each cartridge connection being exposed by the housing and including: a fluid connector for engaging an outlet of a fluid cartridge to allow fluid to flow from the engaged cartridge to one of the plurality of fluid conduits; and an electrical contact arranged to contact a corresponding contact on the engaged fluid cartridge; a printer connection for releasable engagement with an inkjet printer, the printer connection being exposed by the housing and including: a plurality of fluid ports, each fluid port arranged to connect to a fluid pathway within the inkjet printer to allow fluid to flow between one or more of the plurality of fluid conduits and the fluid pathway; and an electrical connector arranged to engage with a corresponding connector on the inkjet printer; and an electrical link between the electrical connector of the printer connection and the electrical contact of each of the two cartridge connections, the electrical link being disposed within the housing.

The removable module according to the first aspect provides an interface between the inkjet printer and each of two fluid cartridges, allowing fluid to flow from each of the fluid cartridges to the inkjet printer and providing an electrical link between the inkjet printer and each of the fluid cartridges. In use a fluid cartridge may be engaged with each of the two cartridge connections. For example, an ink cartridge may be engaged with one of the two cartridge connections and a solvent cartridge may be engaged with the other. During operation of the inkjet printer, ink and solvent may be drawn from the two fluid cartridges. Once either or both fluid cartridge(s) is empty it can be removed from the cartridge connection and replaced.

Since the printer connection provides for releasable engagement with an inkjet printer the removable module can be easily removed from the inkjet printer for servicing or replacement. In general, such servicing or replacement will be performed at a different rate to that of replacement of the fluid cartridges. This is advantageous because during operation of the inkjet printer, one or more components of the removable module may become damaged. The provision of a discrete removable module housing the components mentioned above provides a convenient way of maintaining working, wearing parts of an ink jet printer. In particular a user of the printer can simply remove and replace an integrated module as opposed to being required to replace discrete individual components. The removal and replacement of such an integrated module may be easier to achieve than the replacement of discrete components.

The removable module may be a removable module for an ink supply system of an inkjet printer.

It will be appreciated that an inkjet printer typically includes (a) an ink supply system operable to supply ink and solvent, to mix them to a desired viscosity and to supply the mixture to a print head; and (b) a print head operable to receive the mixture and to project it, as a stream of drops, onto a substrate.

In use, the removable module forms part of an inkjet printer. It will be appreciated that in the expression "for releasable engagement with an inkjet printer" the term "inkjet printer" is intended to mean those parts of the inkjet printer excluding the removable module. By "removable module for the ink supply system," is meant that the module forms part but not the whole of the ink supply system.

It will be appreciated that in the expression "exposed by the housing" is intended to mean that each cartridge connection and the printer connection can be accessed from outside of the housing. To achieve this, the housing may be provided with one or more cut away portions or apertures. The cartridge connections and/or the printer connection, or at least parts thereof, may extend from the housing through such cut away portions or apertures.

The housing may be provided with one or more apertures in the vicinity of each of the cartridge connections and the printer connection.

The removable module may further include a pump arranged to draw fluid from the fluid connector or one or both of the fluid connections to one or more of the plurality of fluid ports of the printer connection. It is particularly advantageous to provide a pump in the removable module since pumps generally have a finite service lifetime and the removable module can easily be replaced.

The removable module may further include an electrical link between the electrical connector of the printer connection and the pump. This allows the pump to be controlled, in use, from the main printer via the electrical connector of the printer connection.

The removable module may further include a pressure relief valve connected across an inlet port and an outlet port of the pump. This allows a desired pressure difference to be maintained across the pump.

The removable module may further include a body disposed within the housing and wherein the body defines the plurality of fluid conduits. Alternatively, the plurality of fluid conduits may be provided by one or more pipes or tubes within the housing.

The body may include two portions and a seal, the two portions being connected together with the seal disposed therebetween. At least one of the two portions may be provided with one or more grooves and at least one of the plurality of conduits may be formed by the one or more grooves when the two portions are connected together. Such an arrangement is easier to form than a one part body. For example each of the two portions may be injection molding and subsequently assembled together with the seal.

The fluid connector of each of the cartridge connections may include a septum needle disposed within a generally cylindrical bore in the housing.

The removable module may further include a plurality of valves disposed within the housing and arranged to selectively link two or more of the plurality of fluid conduits so as to form one or more fluid pathways through the housing.

The plurality of valves may include one or more solenoid valves. Two or more of the plurality of valves may be provided by a single valve body with two or more coils.

The removable module may further include an electrical link between the electrical connector of the printer connection and the or each solenoid valve. This allows the solenoid valves to be controlled, in use, from the main printer via the electrical connector of the printer connection.

The housing may include two portions and the two portions may be connected together.

The removable module may further include a data storage device and an electrical link between the electrical connector of the printer connection and the data storage device. The data storage device may be provided on or in the data storage device. In one embodiment the data storage device is disposed in the housing. The electrical link between the electrical connector of the printer connection and the data storage device allows a controller of the ink jet printer to read data from, and/or write data to, the data storage device. The data storage device may be configured for transferring data to a controller of the ink jet printer.

The removable module may further include a gas sensor and an electrical link between the electrical connector of the printer connection and the gas sensor. The gas sensor may be operable to determine the presence or level of a gas (such as solvent vapor) within the housing. In use, the removable module may be disposed within a cabinet of an inkjet printer. The presence of solvent vapor, or a sufficient level of solvent vapor, in the vicinity of the inkjet printer may indicate a fault (for example a leak). It is particularly advantageous to provide a gas sensor in the removable module since gas sensors can become "poisoned" over time and therefore generally have a finite service lifetime and the removable module can easily be replaced.

According to a second aspect of the invention there is provided an ink jet printer including the removable module of the first aspect.

The ink jet printer may further include a cabinet for housing the removable module.

The inkjet printer according to the second aspect of the invention may include any or all of the features of the removable module of the first aspect of the invention as appropriate. In particular, the removable module may include a gas sensor and an electrical link between the electrical connector of the printer connection and the gas sensor. For such embodiments, the removable module may be disposed in a lower portion of the cabinet. Such an arrangement provides a gas sensor in the lower portion of the cabinet. This is advantageous for detection of solvent vapor within the cabinet because solvent vapor is denser than air and will therefore tend to collect in the lower portion of the cabinet.

One of the cartridge connections may be adapted for releasable engagement with an ink cartridge and the other cartridge connection may be adapted for releasable engagement with a solvent cartridge. The ink jet printer may further include: a print head; an ink storage system; and a controller operable to provide control signals to the removable module, the ink storage system and the print head so as to control the flow of ink and solvent through the inkjet printer.

The ink storage system may be disposed within the cabinet. The printhead may be disposed externally of the cabinet.

The ink jet printer may further include a plurality of printer fluid ports for engagement with the corresponding plurality of fluid ports provided by the printer connection of the removable module. The plurality of printer fluid ports provided by the printer may be connected to the corresponding plurality of fluid ports provided by the printer connection of the removable module via a connector. The connector may be a pin connector.

The ink jet printer may further include a plurality of fluid conduits arranged to provide the fluid pathway, allowing fluid to flow between one or more of the plurality of fluid ports provided by the printer connection of the removable module, and at least one of the ink storage system and the printhead. The printer fluid ports may include ends of the fluid conduits of the printer. The fluid conduits may be referred to as fluid lines.

The ink jet printer may further include an electrical connector for engagement with the electrical connector of the removable module.

The controller may be operable to provide control signals to control a flow of ink and/or solvent from the two cartridge connections to the ink storage system.

The controller may be operable to provide control signals to control a flow of solvent from one of the two cartridge connections to the print head.

The ink jet printer may be a continuous inkjet printer.

According to a third aspect of the invention there is provided apparatus for ink jet printing including: an ink supply system operable to supply ink to a print head; a cabinet for housing the ink supply system; and a gas sensor disposed in the cabinet. The ink may be a solvent based ink and the gas sensor may be operable to sense solvent vapor. A controller configured may be configured to receive a signal from the gas sensor and output a signal based thereon.

The gas sensor may be operable to determine the presence or level of a gas (such as solvent vapor) within the cabinet. The presence of solvent vapor, or a sufficient level of solvent vapor, in the cabinet may indicate a fault (for example a leak from the ink supply system).

The printhead may be disposed externally of the cabinet.

The controller may output an alarm signal based upon sensed solvent vapor. The alarm signal may be an audible or visible alarm signal. The gas sensor may output a signal indicating a concentration of solvent vapor in the cabinet. For example the gas sensor may output an analog signal, the value of which is indicative of the concentration of solvent vapor.

The gas sensor may be disposed in a lower portion of the cabinet. This is advantageous for detection of solvent vapor within the cabinet because solvent vapor is denser than air and will therefore tend to collect in the lower portion of the cabinet. A lower portion of the cabinet may be a lower half of the cabinet or, alternatively, may be adjacent to a base of the cabinet. The gas sensor may be a catalytic gas sensor.

The ink jet printer may be a continuous inkjet printer.

It will be appreciated that for the removable module to be disposed in a lower portion of the cabinet it may be disposed in a lower half of the cabinet. In one embodiment, the removable module may be disposed such that it is on or adjacent to a base of the cabinet.

Embodiments of the present invention will now be described, by way of example, with reference to the accompanying drawings, in which

DETAILED DESCRIPTION

Figure 1:
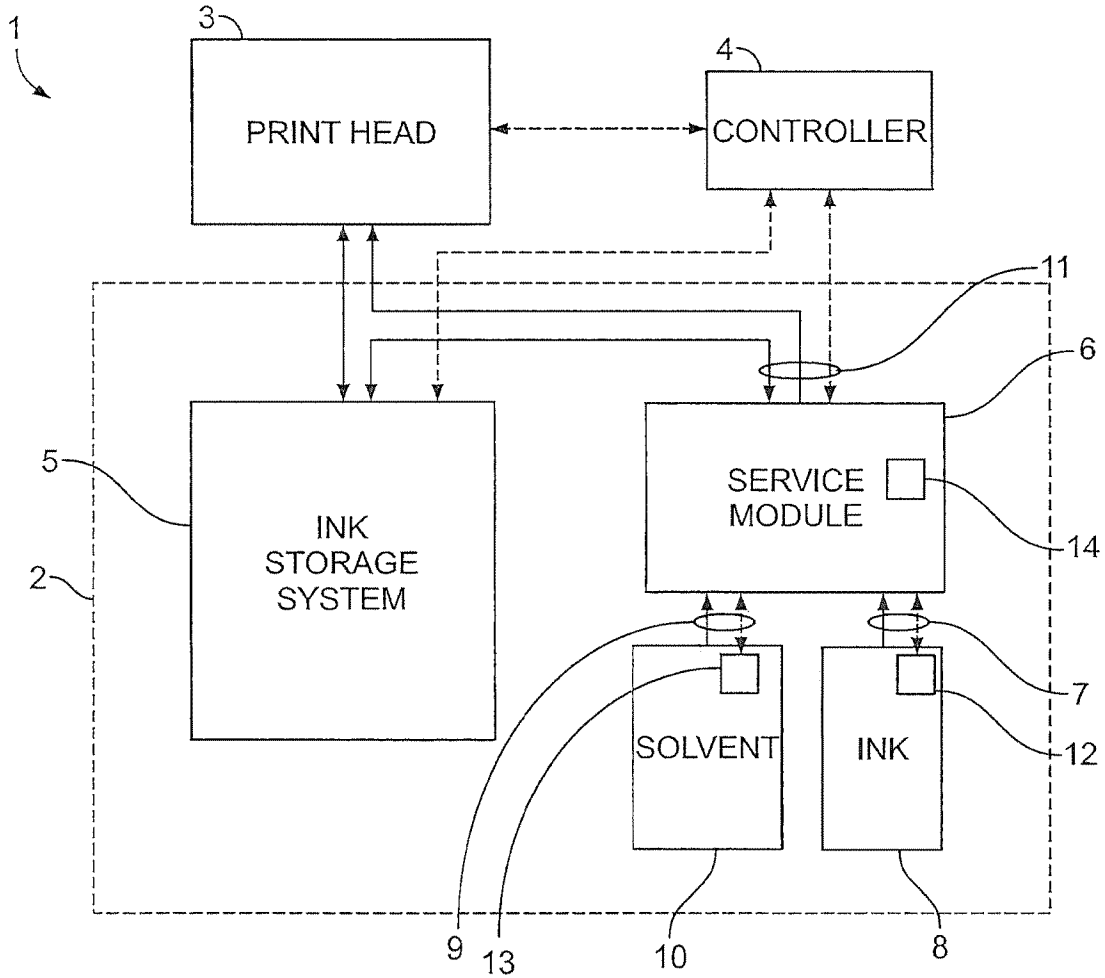
FIG. 1 is a schematic illustration of a continuous ink jet printer in accordance with an embodiment of the invention.

FIG. 1 schematically illustrates an inkjet printer 1. Inkjet printer 1 includes an ink supply system 2, a print head 3 and a controller 4. The ink supply system 2 includes an ink storage system 5 and a service module 6 according to an embodiment of the present invention. In FIG. 1, fluid flow through the inkjet printer is illustrated schematically by solid arrows and control signals are illustrated schematically by dashed arrows. The service module 6 is preferably configured for releasable engagement with inkjet printer 1 so that the module can be easily removed from the inkjet printer 1 for servicing or replacement. The service module 6 is therefore typically a removable module for an inkjet printer.

The service module 6 includes two cartridge connections for releasable engagement with a fluid cartridge. In particular, the service module 6 includes an ink cartridge connection 7 for releasable engagement with an ink cartridge 8 and a solvent cartridge connection 9 for releasable engagement with a solvent cartridge 10. Ink cartridge 8 and solvent cartridge 10 may be any suitable container. The service module 6 further includes a printer connection 11 for releasable engagement with an inkjet printer. In use, the service module 6 forms part of inkjet printer 1 and it will be appreciated that in this context in the expression "for releasable engagement with an inkjet printer" the term "inkjet printer" is intended to mean those parts of the inkjet printer excluding the service module 6.

The printer connection 11 includes a plurality of fluid ports, each fluid port arranged to connect to a fluid pathway within the inkjet printer 1 to allow fluid to flow between the service module 6 and other parts of the inkjet printer 1, such as the ink storage system 5 and the print head 3. The printer connection 11 further includes an electrical connector arranged to engage with a corresponding connector on the inkjet printer 1.

Each of the ink and solvent cartridge connections 7, 9 includes a fluid connector for engaging an outlet of respective ink and solvent cartridges 8, 10 so as to allow fluid to flow from the cartridges 8, 10 into the service module 6. From the service module 6, ink and solvent can flow to the ink storage system 5 via the printer connection 11. In operation, ink from the ink cartridge 8 and solvent from the solvent cartridge 10 can be mixed within the ink storage system 5 so as to generate printing ink of a desired viscosity which is suitable for use in printing. This ink is supplied to the print head 3 and unused ink is returned from the print head 3 to the ink storage system 5. Thus the print head 3 is operable to receive ink from the ink reservoir 18 and to project it, as a stream of drops, onto a substrate. The service module 6 is also operable to provide a flow of solvent to the print head 3 via printer connection 11 for cleaning purposes.

The ink jet printer 1 is controlled by controller 4. Controller 4 receives signals from various sensors within the inkjet printer 1 and is operable to provide appropriate control signals to the ink supply system 2 and the print head 3 to control the flow of ink and solvent through the inkjet printer 1. The controller 4 may be any suitable device known in the art, and typically includes at least a processor and memory.

The ink cartridge 8 may be provided with an electronic data storage device 12 storing data relating to contained ink (e.g. type and quantity of ink). Similarly, the solvent cartridge 10 may be provided with an electronic data storage device 13 storing data relating to contained solvent (e.g. type and quantity of solvent). The service module 6 includes an electronic data storage device 14. Electronic data storage device 14 may store identification data (e.g. an identification code). Electronic data storage device 14 may also store other types of data, such as identification data relating to the type of ink and/or solvent that the service module 6 can be used with (or has previously been used with), a model number of the service module 6 or inkjet printer 1, a serial number, a manufacture date, an expiration date, a date first used in service, number of hours the service module 6 has been used in the inkjet printer 1, service life, and the like. Information stored on any one of the electronic data storage devices 12, 13, 14 may be stored in encrypted form. This may prevent any tampering of the data. The electronic data storage device 14 may include security data so that only suitable or recognized service modules 6 can be used with the inkjet printer 1. The electronic data storage device 14 may also include a writable data portion. The inkjet printer 1 may write to the electronic data storage device 14 to indicate that the service module 6 has reached the end of its service life, so that the service module can no longer be used in the inkjet printer 1 or any other printer.

The controller 4 is arranged to communicate with the electronic data storage devices 12, 13. This communication with the electronic data storage devices 12, 13 of cartridges 8, 10 is via the service module 6. Each of the ink and solvent cartridge connections 7, 9 includes an electrical contact arranged to contact a corresponding contact on the engaged ink or solvent cartridge 8, 10. The corresponding contact on the cartridges 8, 10 allows information to be read from and/or written to data storage devices 12, 13 respectively via the printer connection 11 of the service module 6.

For example, when the ink supply system 2 is first used, data from the electronic data storage device 12 and/or the electronic data storage device 13 is read to ascertain a type of ink and/or solvent being used. Subsequently, when a new ink cartridge or solvent cartridge is used within the printer 1, a check may be made by the controller 4 of data stored on respective electronic data storage devices 12, 13 of the ink cartridge 8 and the solvent cartridge 10 to ensure compatibility. In this way, when the ink supply system 2 is used with a particular type of ink, the controller 4 ensures that the printer 1 is operable (i.e. ensures that ink is allowed to flow from the ink cartridge 8 and/or that solvent is allowed to flow from the solvent cartridge 10) only if data associated with the ink cartridge 8 and/or solvent cartridge 10 as stored on the electronic data storage devices 12, 13 indicates compatibility.

Figure 2:
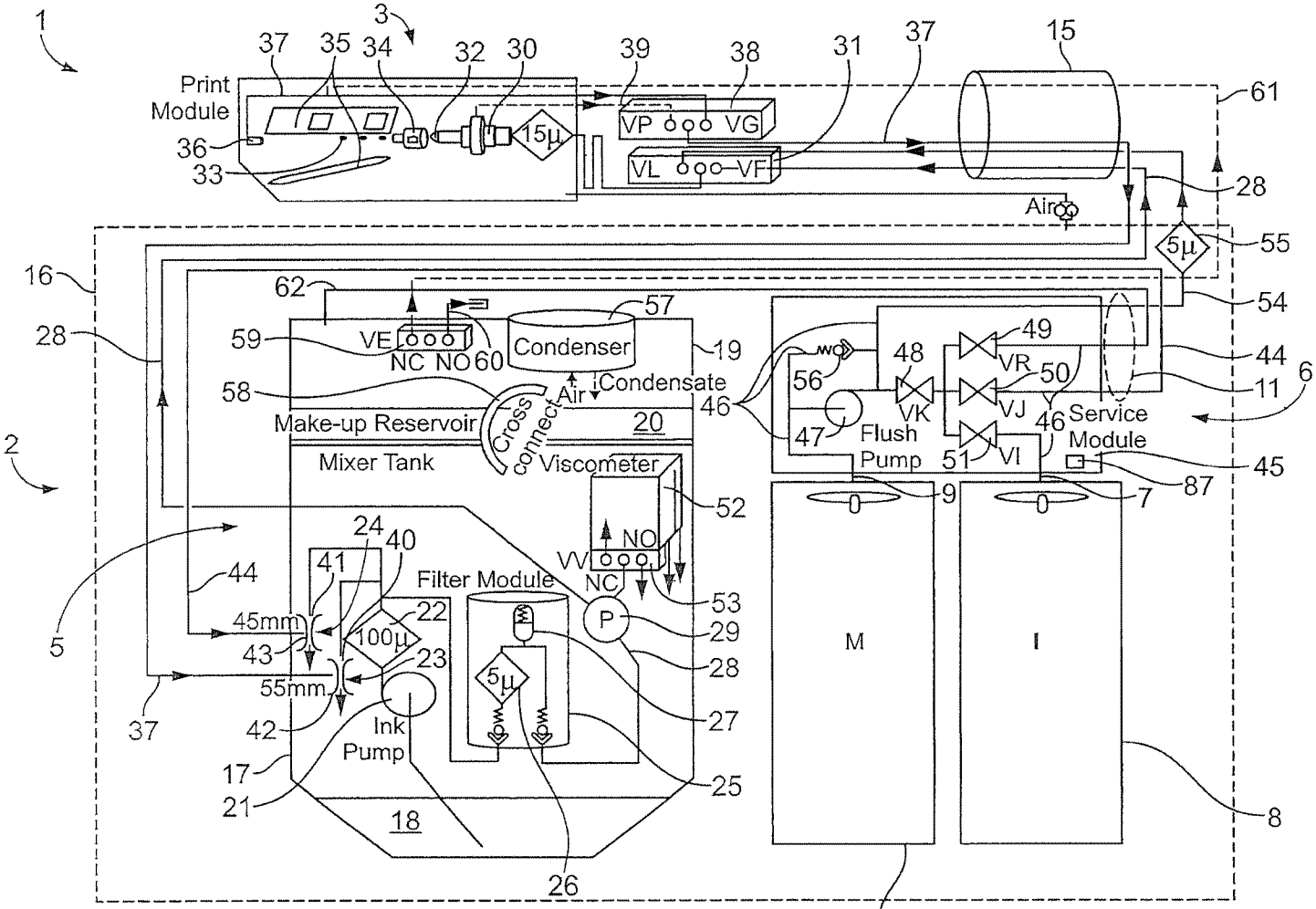
FIG. 2 is a schematic representation of the continuous ink jet printer of FIG. 1.

The ink jet printer 1, and particularly the ink supply system 2 is now described in further detail, with reference to FIG. 2. FIG. 2 schematically shows elements of the ink jet printer 1 of FIG. 1 in greater detail and, for clarity, the controller 4 and associated signals have been omitted.

In operation, ink is delivered under pressure from ink supply system 2 to print head 3 and back via flexible tubes which are bundled together with other fluid tubes and electrical wires (not shown) into what is referred to in the art as an "umbilical" conduit 15. The ink supply system 2 is located in a cabinet 16 which is typically stand mounted and the print head 3 is disposed outside of the cabinet 16.

The ink storage system 5 includes a mixer tank 17 for storage of a reservoir of ink 18 and a solvent tank 19 for storage of a reservoir of solvent 20. The mixer tank has a generally tapered lower portion within which the reservoir of ink 18 is disposed. The ink reservoir 18 is in fluid communication with the module 6.

In operation, ink is drawn from the reservoir of ink 18 in mixer tank 17 by a system pump 21. The mixer tank 17 is topped up as necessary with ink and make-up solvent from replaceable ink and solvent cartridges 8, 10. Ink and solvent are transferred from the ink and solvent cartridges 8, 10 to the mixer tank 17 via the service module 6 as will be described further below.

It will be understood from the description that follows that the ink supply system 2 and the print head 3 include a number of flow control valves which are of the same general type: a dual coil solenoid-operated two-way flow control valve. The operation of each of the valves is governed by the controller 4.

Ink drawn from the mixer tank 17 is filtered first by a first (relatively coarse) filter 22 downstream of the system pump 21 and then is delivered selectively under pressure to two venturi pumps 23, 24 and a filter module 25. Filter module 25 includes a second, finer ink filter 26 and a fluid damper 27. Fluid damper 27 is of conventional configuration and removes pressure pulsations caused by the operation of the system pump 21. Ink is supplied through a feed line 28 to the print head 3 via a pressure transducer 29.

At the print head 3 the ink from the feed line 28 is supplied to a drop generator 30 via a first flow control valve 31. The drop generator 30 includes a nozzle 32 from which the pressurized ink is discharged and a piezoelectric oscillator (not shown) which creates pressure perturbations in the ink flow at a predetermined frequency and amplitude so as break up the ink stream into drops 33 of a regular size and spacing. The break up point is downstream of the nozzle 32 and generally coincides with a charge electrode 34 where a predetermined charge is applied to each drop 33. This charge determines the degree of deflection of the drop 33 as it passes a pair of deflection plates 35 between which a substantially constant electric field is maintained. Uncharged drops pass substantially undeflected to a gutter 36 from where they are recycled to the ink supply system 2 through return line 37 via a second flow control valve 38. Charged drops are projected towards a substrate (not shown) that moves past the print head 3. The position at which each drop 33 impinges on the substrate is determined by the amount of deflection of the drop and the speed of movement of the substrate.

To ensure effective operation of the drop generator 30 the temperature of the ink entering the print head 3 may be maintained at a desired level by a heater (not shown) before it passes to the first control valve 31. In instances where the printer is started up from rest it is desirable to allow ink to bleed through the nozzle 32 without being projected toward the gutter 36 or substrate. In such instances ink flows from the first control valve 31 to the nozzle 32 and then returns to the second control valve 38 via a bleed line 39, where it joins return line 37. The passage of the ink into the return line 37, whether it is the bleed flow or recycled unused ink captured by the gutter 36, is controlled by the second flow control valve 38. The returning ink is drawn back to the mixer tank 17 by venturi pump 23.

Venturi pumps 23, 24 are of known configuration and make use of the Bernoulli Principle whereby fluid flowing through a restriction in a conduit increases to a high velocity jet at the restriction and creates a low pressure area. If a side port is provided at the restriction this low pressure can be used to draw in and entrain a second fluid in a conduit connected to the side port. In this instance, the pressurized ink flows through a pair of conduits 40, 41 and back to the reservoir 18 in the mixer tank 17. Each conduit 40, 41 is provided with a side port 42, 43 at the venturi restriction. The increase in flow velocity of the ink creates a suction pressure at the side port 42, 43 and this serves to draw returning ink and/or solvent through return line 37 and a supply line 44 respectively.

As ink flows through the system and comes into contact with air in the mixer tank 17 and at the print head 3, a portion of its solvent content tends to evaporate. The ink supply system 2 is therefore operable to supply make-up solvent as required so as to maintain the viscosity of the ink within a predefined range suitable for use.

The service module 6 includes a body 45 defining a plurality of fluid conduits (shown schematically in FIG. 2 as lines 46). The service module 6 further includes a flush pump 47 and four valves 48, 49, 50, 51 which are arranged to selectively link two or more of the plurality of fluid conduits 46 so as to form one or more fluid pathways through the body 45. The flush pump 47 and the valves 48, 49, 50, 51 are controlled by the controller 4 by sending one or more control signals via the printer connection 11. Using appropriate control signals, the service module 6 can be disposed in a plurality of different configurations to allow ink or solvent to flow through the inkjet printer 1 in a plurality of different modes, as now described. In the following, it should be assumed that each of the four valves 48, 49, 50, 51 is closed unless stated otherwise.

In operation, ink from the ink cartridge 8 and solvent from the solvent cartridge 10 can be added to the mixer tank 17 as required so as to generate printing ink of a desired viscosity which is suitable for printing. This addition of ink and/or solvent to the mixer tank 17 uses venturi pump 24.

Mixer tank 17 is provided with a level sensor (not shown) that is operable to determine a level of ink in the mixer tank 17 and output a signal indicative thereof to controller 4. Ink is consumed during printing and therefore during normal operation the level of ink in the mixer tank 17 will fall over time. When the level of ink in the mixer tank falls below a lower threshold the controller 4 is operable to control the ink supply system 2 so as to add more ink to the mixer tank 17. Using suitable control signals, ink is drawn from the mixer tank 17 by system pump 21 and delivered under pressure to venturi pump 24 to create suction pressure at the side port 43. To add ink to the mixer tank 17, valves 50, 51 in the service module 6 are opened. Ink is drawn from ink cartridge 8 along supply line 44 under suction pressure from venturi pump 24. The ink discharges into the mixer tank 17, increasing the level. When the level of ink in the mixer tank 17 reaches an upper threshold the controller 4 is operable to stop the supply of ink to mixer tank 17. To achieve this, flow to venturi pump 24 is stopped and valves 50, 51 are closed.

Following such a process of topping up the level of ink in mixer tank 17, the controller 4 sends a signal to data storage device 12 on ink cartridge 8 indicative of the quantity of ink that has been transferred from the cartridge 8 to the mixer tank 17. A quantity of ink remaining in the ink cartridge 8 may be stored on the data storage device 12 and may be updated in response to the signal from the controller 4.

As explained above, as ink flows through the system and comes into contact with air in the mixer tank 17 and that the print head 3, a portion of its solvent content tends to evaporate. Periodically, the viscosity of the ink within the mixer tank 17 (or a quantity indicative thereof) is determined using a viscometer 52 disposed in mixer tank 17.

The viscometer 52 is periodically supplied with ink under pressure from system pump 21 via filter module 25. How of ink into the viscometer is controlled by control valve 53. Using control valve 53, a predetermined volume of ink is supplied to a chamber within viscometer 52 and then supply of ink to the viscometer is stopped. Ink then drains out of the chamber under gravity. The rate at which the ink drains out of the chamber is dependent on the viscosity of the ink and is monitored using a plurality of electrodes disposed at different levels within the chamber. Signals from the plurality of electrodes are received by controller 4, which is operable to determine whether or not the viscosity of ink within the mixer tank 17 is within a desired operating range, defined by lower and upper threshold values.

If the viscosity is above the upper threshold value then solvent is added to the mixer tank 17 from solvent reservoir 20 in solvent tank 19 as now described. Ink is drawn from the mixer tank 17 and delivered under pressure to venturi pump 24 to create suction pressure at the side port 43. To add solvent, valves 49, 50 in the service module 6 are opened. Under suction pressure from the venturi pump 24, solvent is drawn from solvent reservoir 20 along line 62 to the service module 6 and back along supply line 44 to the mixer tank 17. The solvent discharges into the mixer tank 17, reducing the viscosity of the ink in reservoir 18.

The controller 4 may determine a quantity of solvent to add to the mixer tank 17 based on the determined viscosity of the ink. When a desired quantity of solvent has been added to the mixer tank 17, flow to the venturi pump 24 may be stopped and the valves 49, 50 are closed.

Once solvent has been added to the mixer tank 17, the viscometer 52 may be used again to determine the viscosity of ink. There may be a time delay between adding the solvent and re-checking the viscosity of the ink so as to allow the solvent to mix with ink. If upon re-checking the viscosity of the ink in mixer tank 17 the viscosity is still above the upper threshold value then more solvent may be added to the mixer tank 17 from solvent reservoir 20 in solvent tank 19. This process may be repeated until a desired viscosity of ink in mixer tank 17 is reached.

Solvent tank 19 is provided with a level sensor (not shown) that is operable to determine a level of solvent in the solvent tank 19 and output a signal indicative thereof to controller 4. Solvent is consumed during operation of the printer 1 as it is added to the mixer tank 17 to adjust the viscosity of the ink in reservoir 18. Therefore the level of solvent in the solvent reservoir 20 in solvent tank 19 falls over time.

When the level of solvent in the solvent tank 19 falls below a lower threshold, the controller 4 is operable to control the ink supply system 2 so as to add more solvent to the solvent tank 19. Using suitable control signals, valves 48, 49 in the service module 6 are opened. Solvent is drawn from solvent cartridge 10 by electric flush pump 47 in the service module 6 and is supplied through line 62 to the solvent reservoir 20. The solvent discharges into the solvent reservoir 20, increasing the level.

When the level of solvent in the solvent tank 19 reaches an upper threshold the controller 4 is operable to stop the supply of solvent to solvent tank 19. To achieve this, flow to flush pump 47 is stopped and valves 48, 49 are closed.

Following such a process of topping up the level of solvent in solvent tank 19, the controller 4 sends a signal to data storage device 13 on solvent cartridge 10 indicative of the quantity of solvent that has been transferred from the cartridge 10 to the solvent tank 19. A quantity of solvent remaining in the solvent cartridge 10 may be stored on the data storage device 13 and may be updated in response to the signal from the controller 4.

Make-up solvent, provided from the solvent cartridge 10, is also used to flush the print head 3 at appropriate times to keep it clear of blockages, as now described. Ink is drawn from the mixer tank 17 and delivered under pressure to venturi pump 23 to create a suction pressure at the side port 42. Solvent is drawn from solvent cartridge 10 by electric flush pump 47 in the service module 6 and is supplied through a flush line 54 to the print head 3 via filter 55. Flow of solvent from the service module 6 to the print head 3 is controlled by first control valve 31.

A pressure relief valve 56 is connected across the inlet and outlet of the flush pump 47 and acts to relieve excess pressure to the suction side of the flush pump 56. For example, pressure relieve valve 56 may be arranged to maintain a desired pressure downstream of the flush pump 47, for example 2.5 bar.

The solvent flows through the first control valve 31 to the nozzle 32. After passing through the nozzle 32 and into the gutter 36 the solvent (along with dissolved ink from the print head 3) is drawn into the return 32 under suction pressure from the venturi pump 23. The solvent and ink discharge into the mixer tank 17.

As explained above, flow of ink and solvent into mixer tank 17 is achieved using venturi pump 24, which requires a minimum quantity of fluid in mixer tank 17. If there is insufficient fluid in the mixer tank 17 for operation of the venturi pump 24 (e.g. before a first use of the ink supply system 2), the flush pump 47 in service module 6 can be used to prime the mixer tank 17 by adding fluid to it.

To prime the mixer tank 17, an ink cartridge is engaged with the solvent cartridge connection 9. To add ink to the mixer tank 17, valves 48, 50 in the service module 6 are opened. Ink is drawn from an ink cartridge (in the solvent cartridge connection 9) by electric flush pump 47 in the service module 6 and is supplied through supply line 44 to the mixer tank 17 via side port 42. Once a sufficient quantity of ink has been added to the mixer tank 17, flush pump 47 is stopped and valves 48, 50 are closed.

In use, the atmosphere in the mixer tank 17 and the solvent tank 19 can become saturated with solvent. A condenser unit 57 is provided in an upper portion of the solvent tank 19. Condenser unit 57 may, for example, include a Peltier-type condenser.

A ventilation tube 58 is provided between the mixer tank 17 and the solvent tank 19 to allow air to flow therebetween. The ventilation tube 58 is arranged such that it links a space above the reservoir of ink 18 to a space above the reservoir of solvent 20. Solvent-laden vapor from the mixer tank 17 enters the solvent tank 19 via ventilation tube 58. The air from the mixer tank 17 is warmer than the air in the solvent tank (due to the action of the system pump 21), and therefore it rises to the top of the solvent tank via ventilation tube 58, where it enters the condenser unit 57.

Solvent condenses as the air contacts an active element within the condenser unit 57 and is cooled. The condensate (solvent) drains into the solvent reservoir 20. The dried air (from which the solvent has been removed) enters the common port of a three-way control valve 59. The flow of air through the system can be controlled using control valve 59, as now described.

The dried air from the condenser unit 57 may flow through exit line 60, via which it is vented to the air space inside the printer cabinet 16. This air flow path may be a default configuration for control valve 59.

Alternatively, the dried air from the condenser unit 57 may flow through line 61 which passes through the umbilical 15 to the print head 3. Line 61 terminates in the print head 3 at return line 37, near the gutter 36. Vacuum pressure draws the vented air along the return line 37 towards the second control valve 38 (along with any ink entering the gutter 36). Normal operation of venturi pump 23 draws the unused ink drops and vented air along the return line 37, through the umbilical 15 and back to side port 42. The unused ink and vented air are both discharged into the mixer tank 17.

When control valve 59 is used to direct the dried air from the condenser unit 57 through line 61, a 'closed' hydraulic loop is created. Any solvent vapor which is not recovered by the condenser unit 57 passes back to the mixer tank 17 via lines 61, 32 and loss of solvent from the inkjet printer 1 is therefore minimized. The system recirculates the same air continuously, which prevents (or at least minimizes) the influx of ambient air, which would otherwise enter via the gutter 36 (e.g. if the control valve 59 is venting the dried air from the condenser unit 57 to the air space inside the printer cabinet 16 via exit line 60). This preclusion of ambient air entering the system helps to prevent oxygen ingestion via the gutter 36, which promotes improved ink performance over the long term by reducing the probability of ink oxidation.

As will be described in more detail below, in some embodiments, the service module 6 further includes a gas sensor 87, which may be operable to determine the presence or level of a gas (such as solvent vapor) within the cabinet 16. Gas sensors can become "poisoned" over time and therefore generally have a finite service lifetime, requiring replacement thereafter.

The service module 6 provides an interface between the inkjet printer 1 and each of ink and solvent cartridges 8, 10, allowing fluid to flow from each of the cartridges 8, 10 to the inkjet printer and providing an electrical link between the inkjet printer 1 and each of the cartridges 8, 10. Since the printer connection 11 provides for releasable engagement with an inkjet printer the service module 6 can be easily removed from the inkjet printer 1 for servicing or replacement. In general, such servicing or replacement will be performed at a different rate to that of replacement of the fluid cartridges 8, 10, or the rate of replacement of other replaceable components of the printer 1. This is advantageous because during operation of the inkjet printer 1, one or more of the plurality of conduits 46, valves 48, 49, 50, 51 and flush pump 47 may become blocked or damaged, or the gas sensor 87 may reach the end of its useful life.

Figure 3:
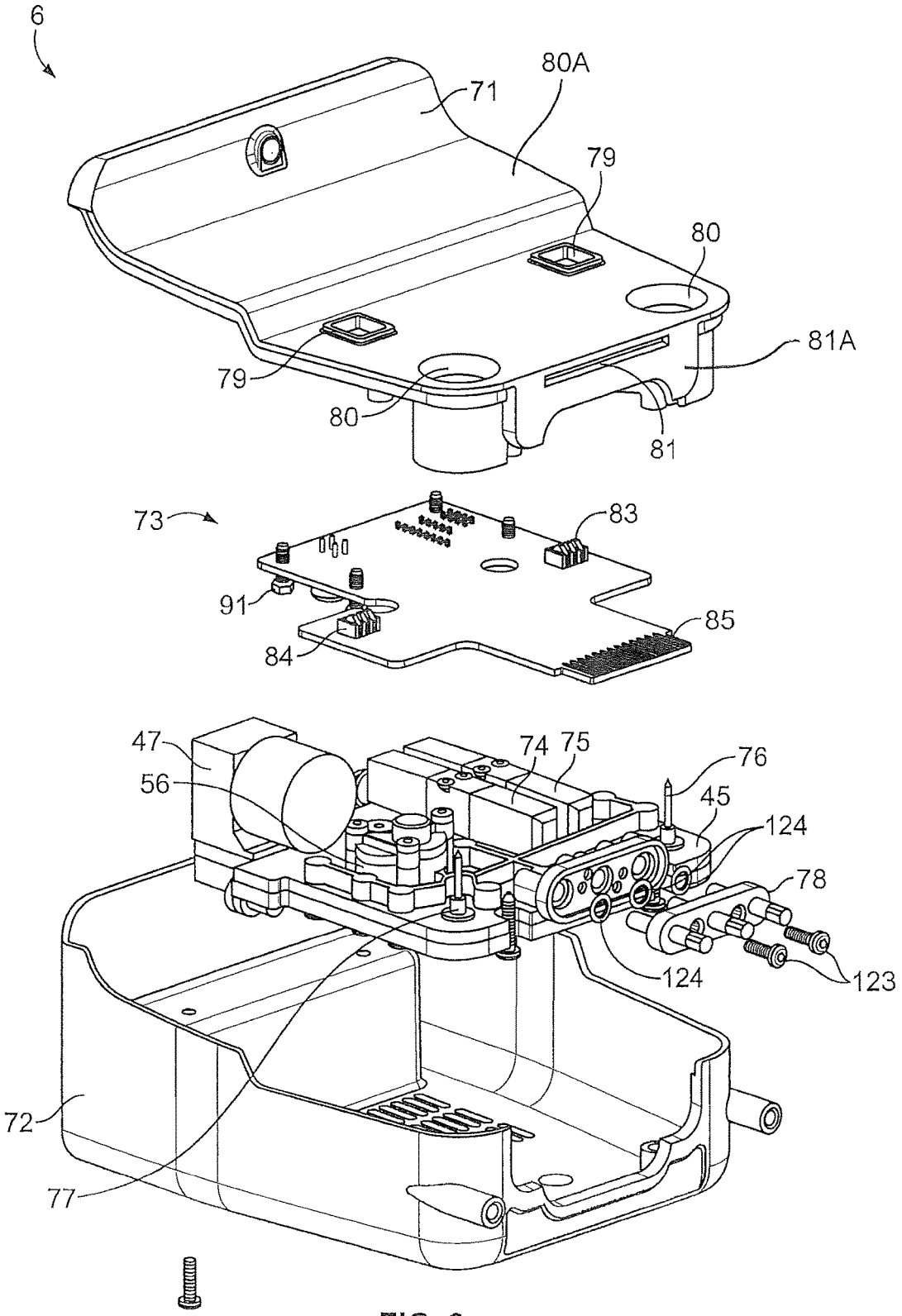
FIG. 3 is an exploded view of a service module in accordance with an embodiment of the invention which forms part of the ink jet printer of FIGS. 1 and 2.

FIG. 3 shows an exploded view of an embodiment of the service module 6.

Service module 6 includes a housing, which is formed from upper and lower housing portions 71, 72. Housed within the housing, the service module 6 includes a printed circuit board 73, the body 45, the pump 47, the pressure relief valve 56, two valve bodies 74, 75, two septum needle assemblies 76, 77 and a fluid pin block 78.

The upper portion 71 of the housing provides an ink cartridge receiving portion and a solvent cartridge receiving portion. The upper portion 71 of the housing includes two generally square apertures 79 and two generally circular apertures 80 disposed in surface 80A. A front surface 81A of the upper portion 71 of housing is provided with a slit 81.

The two septum needle assemblies 76, 77 each provide a fluid connector for engaging an outlet of a fluid cartridge to allow fluid to flow from the engaged cartridge to one of the plurality of fluid conduits 46 of the body 45 (see FIG. 2).

Figure 4A:
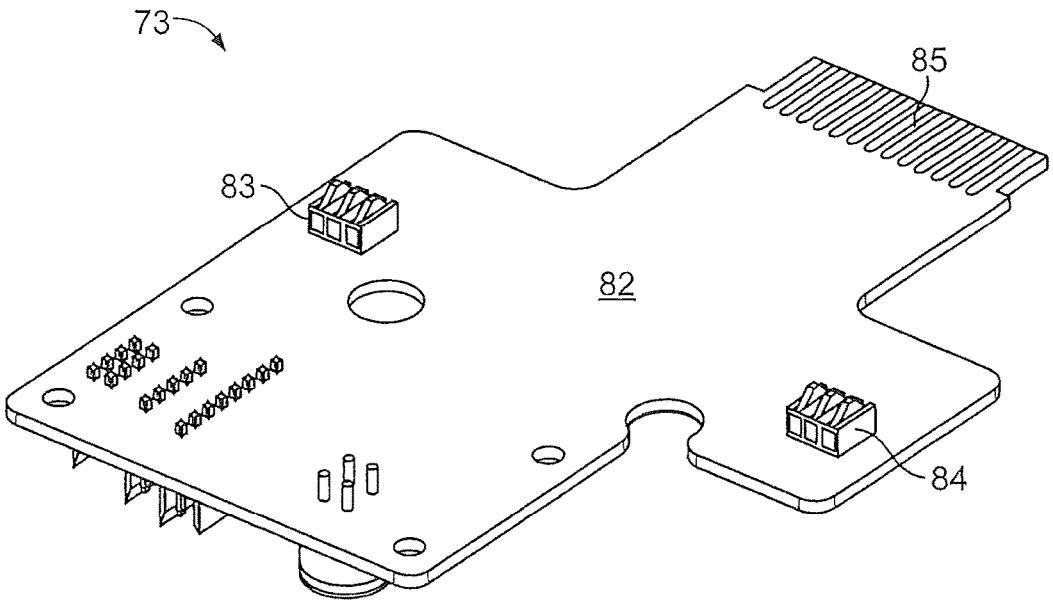
FIG. 4A is a perspective view of an upper surface of a printed circuit board which forms part of the service module shown in FIG. 3.
Figure 4B:
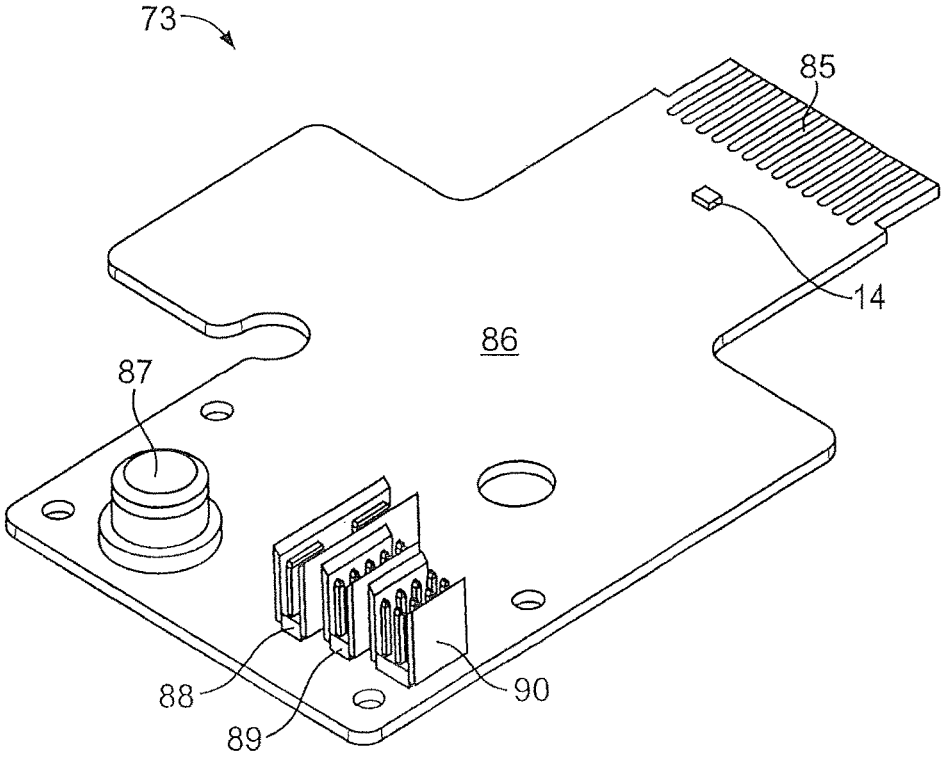
FIG. 4B is a perspective view of an lower surface of a printed circuit board which forms part of the service module shown in FIG. 3.

As shown more clearly in FIGS. 4A and 4B, printed circuit board 73 is provided on an upper side 82 thereof with two electrical connectors 83, 84. The two connectors 83, 84 may be of known type having one or more spring biased electrical contacts. In one embodiment, the two connectors 83, 84 may include a standard three-way battery connector. The printed circuit board 73 is further provided with a card edge connector 85 provided along one edge of the printed circuit board 73. Card edge connector 85 is of known construction and includes a plurality of conductive strips provided on the surface of the printed circuit board 73.

Printed circuit board 73 is provided on a lower side 86 thereof with electronic data storage device 14, a gas sensor 87 and three connectors 88, 89, 90.

Printed circuit board 73 is provided with electrical links between the card edge connector 85 and each of: the connectors 83, 84, the electronic data storage device 14, the gas sensor 87, and the electrical connectors 88, 89, 90. In use, this allows signals to be sent between each of these and the controller 4 via card edge connector 85.

The gas sensor 87 may be operable to determine the presence or level of a gas (such as solvent vapor) within the housing 71, 73. The gas sensor 87 may be operable to send a signal indicative of the presence or level of a gas to controller 4. Such a signal may be sent continuously, intermittently or upon request. The presence of solvent vapor in the vicinity of the inkjet printer 1 may indicate a fault (for example an ink or solvent leak, or a failure of an air circulation system the purpose of which is to remove solvent vapor from interior spaces of the printer). Solvent vapors of interest will typically include acetone, methyl ethyl ketone, and ethanol, as well as similar ketone- and alcohol-based solvents, which are typically used with inkjet inks. As such, when a signal indicating the presence of solvent vapor, or a greater than expected concentration of solvent vapor, is received by the controller 4 the controller 4 may output an alarm signal in the form of an audible or visible alarm signal. Therefore it is desirable to provide a gas sensor in the vicinity of an ink jet printer, for example within a cabinet of the printer. Gas sensors can become "poisoned" over time and therefore generally have a finite service lifetime, requiring replacement thereafter. It is particularly advantageous to provide a gas sensor 87 in the service module 6 since service module is easily replaceable (by virtue of its printer connection 11). The gas sensor 87 may be a catalytic gas sensor. Suitable gas sensors include the NAP-50A catalytic gas sensor and the NAP-56A catalytic gas sensor, both available from Nemoto (Europe) B.V. of the Netherlands.

In use, the service module 6 may be disposed in a lower portion of the cabinet 16 of inkjet printer 1. This is particularly advantageous for detection of solvent vapor within the cabinet 16 because solvent vapor is often denser than air and will therefore tend to collect in the lower portion of the cabinet 16.

Connectors 88, 89, 90 provide connections to the flush pump 47 and each of the valve bodies 74, 75. In use, this allows signals to be send between each of the flush pump 47 and the valve bodies 74, 75 by the controller 4 via card edge connector 85 and one of connectors 88, 89, 90.

The printed circuit board 73 is attached to the upper portion 71 of housing, as now described. The edge of printed circuit board 73 which is provided with card edge connector 85 is received through the slit 81 in the front surface 81A of the upper portion 71 such that the card edge connector 85 protrudes out of the upper portion 71. The printed circuit board 73 is typically attached to the upper portion 71 of housing using four screws 91 and is positioned relative thereto such that the two connectors 83, 84 are each aligned with one of the generally square apertures 79.

Card edge connector 85 (which protrudes out of the upper portion 71) provides an electrical connector arranged to engage with a corresponding connector on an inkjet printer. Each of the two connectors 83, 84 (which are each aligned with one of the generally square apertures 79) provides an electrical contact arranged to contact a corresponding contact on an engaged fluid cartridge.

Together, septum needle assembly 76 and connector 83 form the ink cartridge connection 7 for releasable engagement with ink cartridge 8 (with septum needle assembly 76 forming the fluid connector and connector 83 forming the electrical contact). Similarly, together, septum needle assembly 77 and connector 84 form the solvent cartridge connection 9 for releasable engagement with solvent cartridge 10 (with septum needle assembly 77 forming the fluid connector and connector 84 forming the electrical contact). Septum needle assemblies 76, 77 are accessible via generally circular apertures 80 and electrical connectors 83, 84 are accessible via generally square apertures 79, which are preferably disposed on surface 80A. Therefore, the ink and solvent cartridge connections 7, 9 are both exposed by the housing 71, 72.

Figure 5:
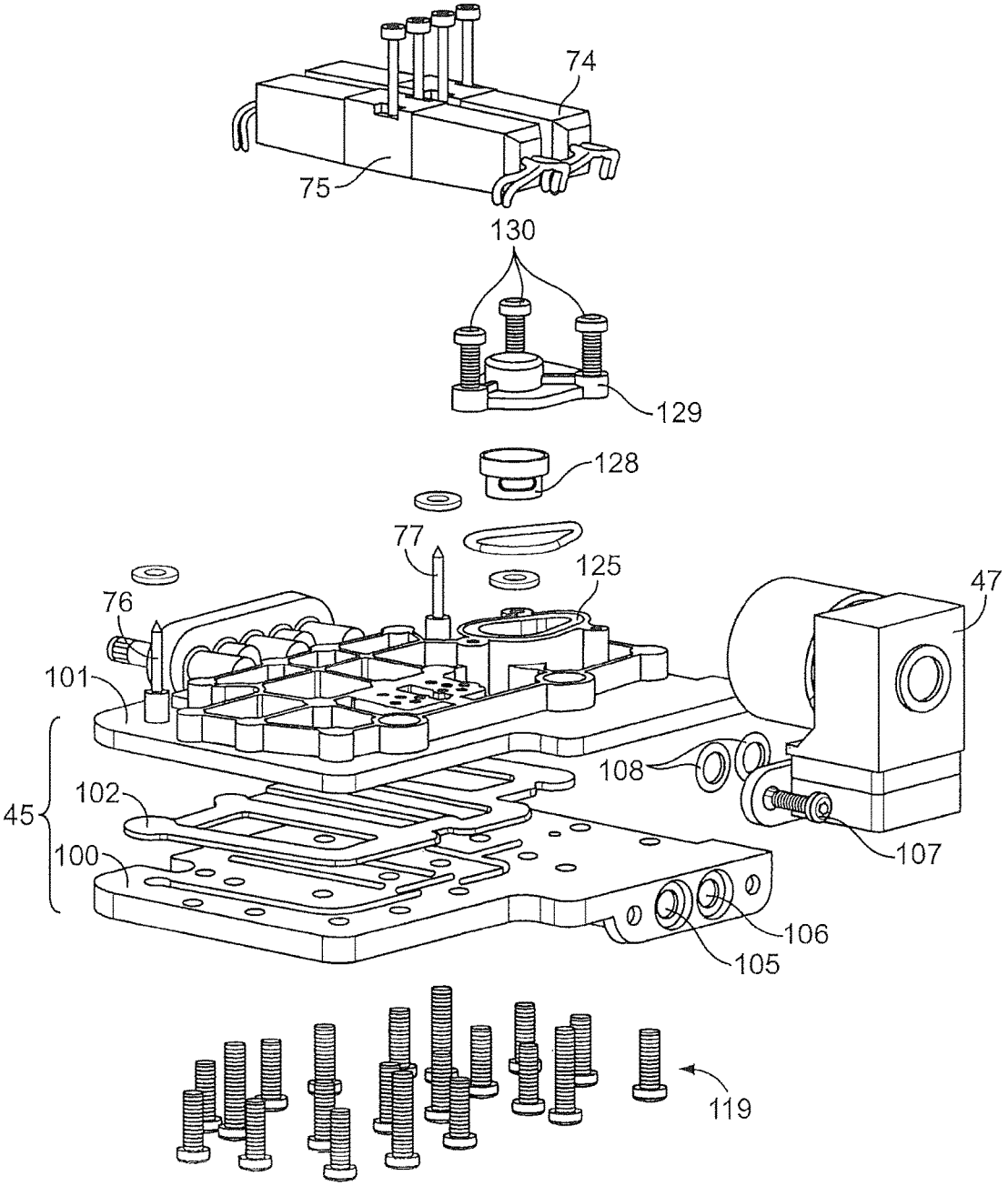
FIG. 5 is an exploded view of part of the service module shown in FIG. 3, including a two-part body.

As can be more clearly seen in the exploded view of FIG. 5, the body 45 includes lower and upper portions 100, 101 with a seal 102 provided therebetween.

Figure 6A:
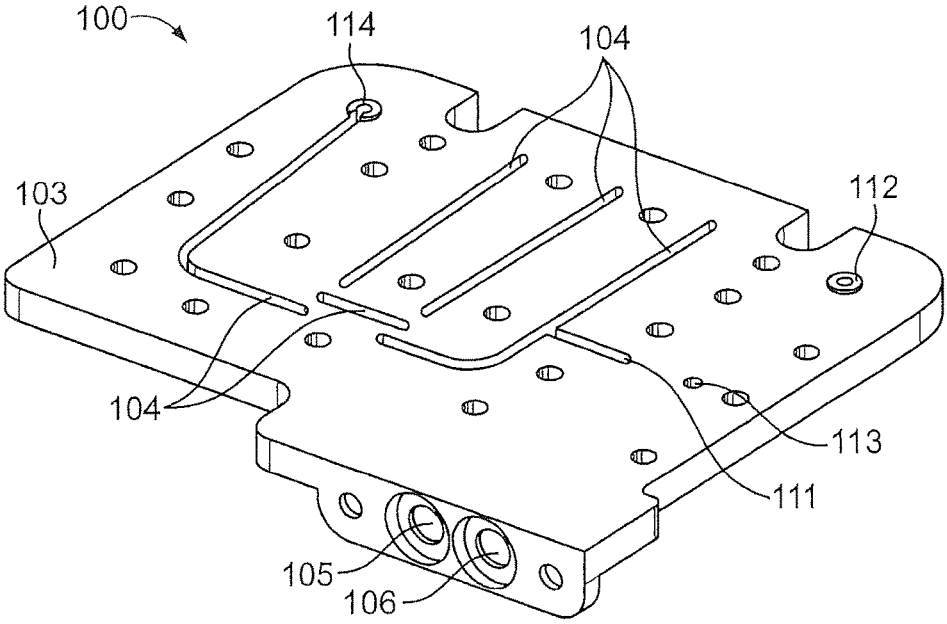
FIG. 6A is a perspective view of an upper surface of a lower portion of the body shown in FIG. 5.
Figure 6B:
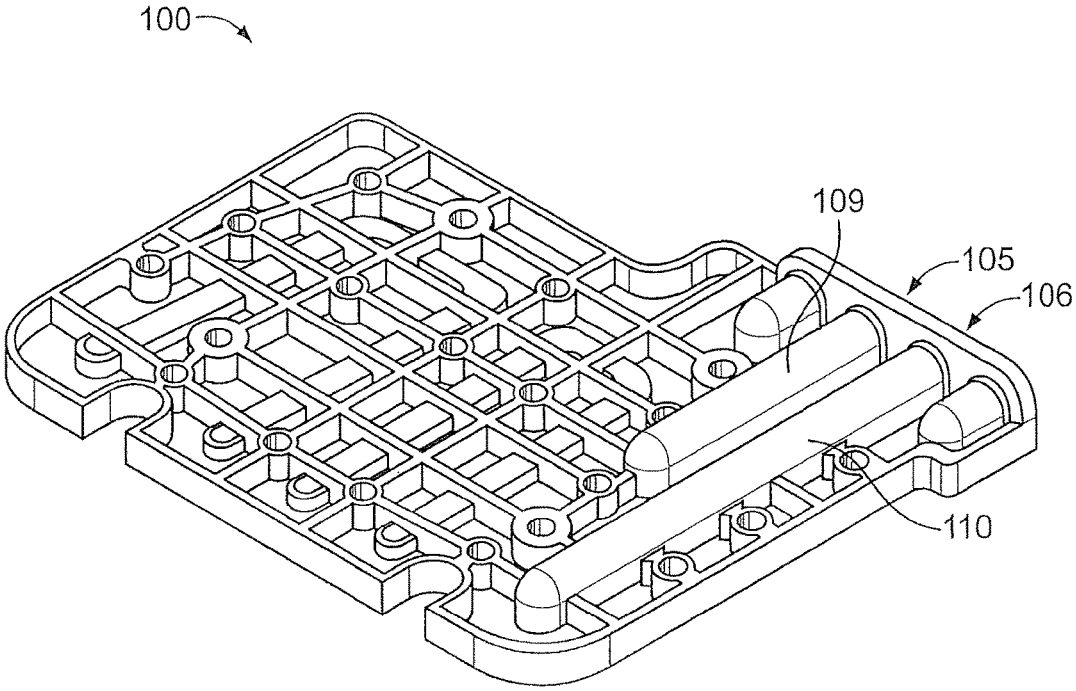
FIG. 6B is a perspective view of a lower surface of a lower portion of the body shown in FIG. 5.

The lower portion 100 of body 45 is shown in FIGS. 6A and 6B. An upper surface 103 of the lower portion 100 of body 45 is generally flat and is provided with a plurality of grooves 104.

A front surface of the lower portion 100 of body 45 defines two apertures 105, 106 for connection to the flush pump 47. The flush pump 47 is attached to the lower portion 100 of the body 45 (see FIG. 5) using two screws 107 such that an inlet port of the flush pump 47 is connected to aperture 106 and an outlet port of flush pump 47 is connected to aperture 105. An o-ring seal 108 is provided between each aperture 105, 106 and the corresponding port of the flush pump 47. In one embodiment, the service module 6 does not include a fluid reservoir (for example, the module does not contain more than 25 mL, 50 mL, or 100 mL of printing fluid at a given time), as the ink reservoir and/or mixing tank is positioned elsewhere in the ink supply system 2. In another embodiment, the service module 6 does not include a filter of any type, as the filter(s) is/are positioned elsewhere in the ink supply system 2.

As can be seen in FIG. 6B, respective conduits 109, 110 extend away from each of the apertures 105, 106 below the upper surface 103 of the lower portion 100 of body 45. A first conduit 109 extends from aperture 105 on the front surface to an aperture 111 on the upper surface 103 and a second conduit 110 extends from aperture 106 on the front surface to an aperture 112 on the upper surface 103. An aperture 113 is provided on the upper surface 103, which extends down to the second conduit 110 at a point between the apertures 106, 112.

In use, the pressure relief valve 56 is provided across apertures 111, 113 on upper surface 103. In use, the septum needle assembly 77 (which forms part of the solvent cartridge connection 9) connects to aperture 112, connecting the septum needle assembly 77 to the inlet port of the flush pump 47 (via conduit 110 and aperture 106). In use, the septum needle assembly 76 (which forms part of the ink cartridge connection 7), connects to an end 114 of one of the plurality of grooves 104.

Figure 7A:
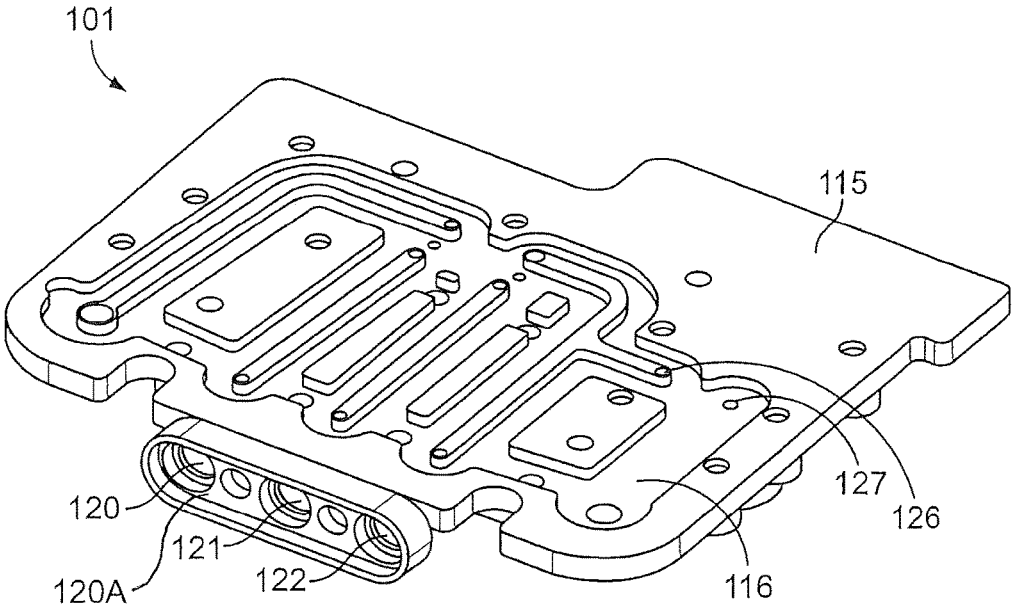
FIG. 7A is a perspective view of an lower surface of an upper portion of the body shown in FIG. 5.
Figure 7B:
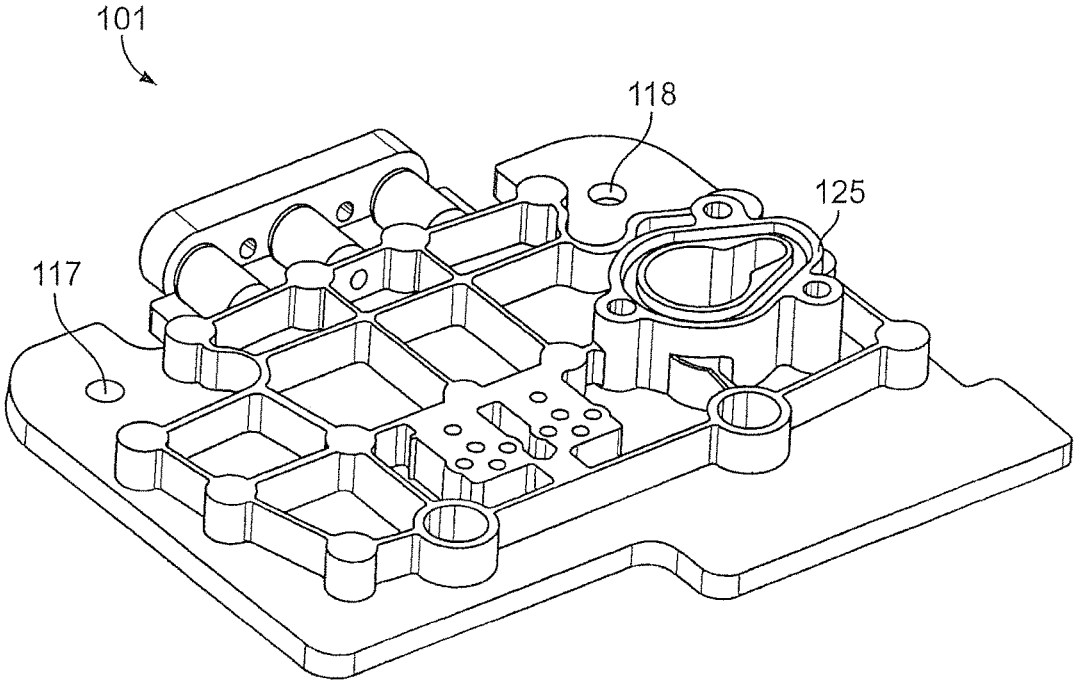
FIG. 7B is a perspective view of an upper surface of an upper portion of the body shown in FIG. 5.

The upper portion 101 of body 45 is shown in FIGS. 7A and 7B. A lower surface 115 of the upper portion 101 of body 45 is generally flat and is provided with a recessed region 116 for receipt of the seal 102.

Two apertures 117, 118 are provided in the upper portion 101 of body 45. Referring to FIG. 5, the septum needle assembly 77, which forms part of the solvent cartridge connection 9, is connected to aperture 118 and the septum needle assembly 76, which forms part of the ink cartridge connection 7, is connected to aperture 117.

Figure 8:
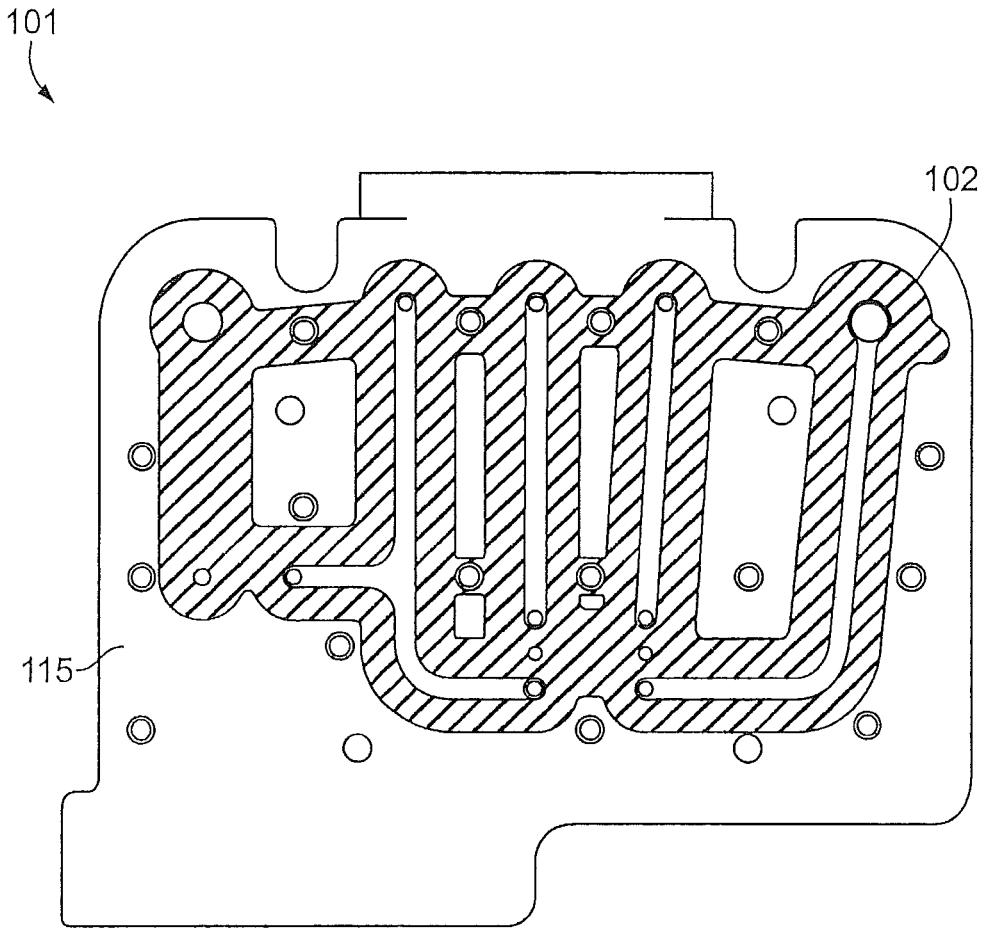
FIG. 8 is a plan view of the lower surface of the upper portion of the body and a seal, as shown in FIG. 5.

FIG. 8 is a plan view of the lower surface 115 of the upper portion 101 of body 45 with the seal 102 received in recessed region 116.

Mutual attachment of the upper and lower portions 101, 100 is achieved by way of a plurality of screws 119. When the upper and lower portions 101, 100 are so attached (with seal 102 arranged therebetween), the recessed portion 116, grooves 104 and seal 102 together form a plurality of conduits through body 45 with a layout corresponding to the layout of grooves 104. The along with conduits 109, 110 in lower portion 100, the conduits thus formed by recessed portion 116, grooves 104 and seal 102 provide the plurality of conduits 46 defined by body 45.

Figure 9:
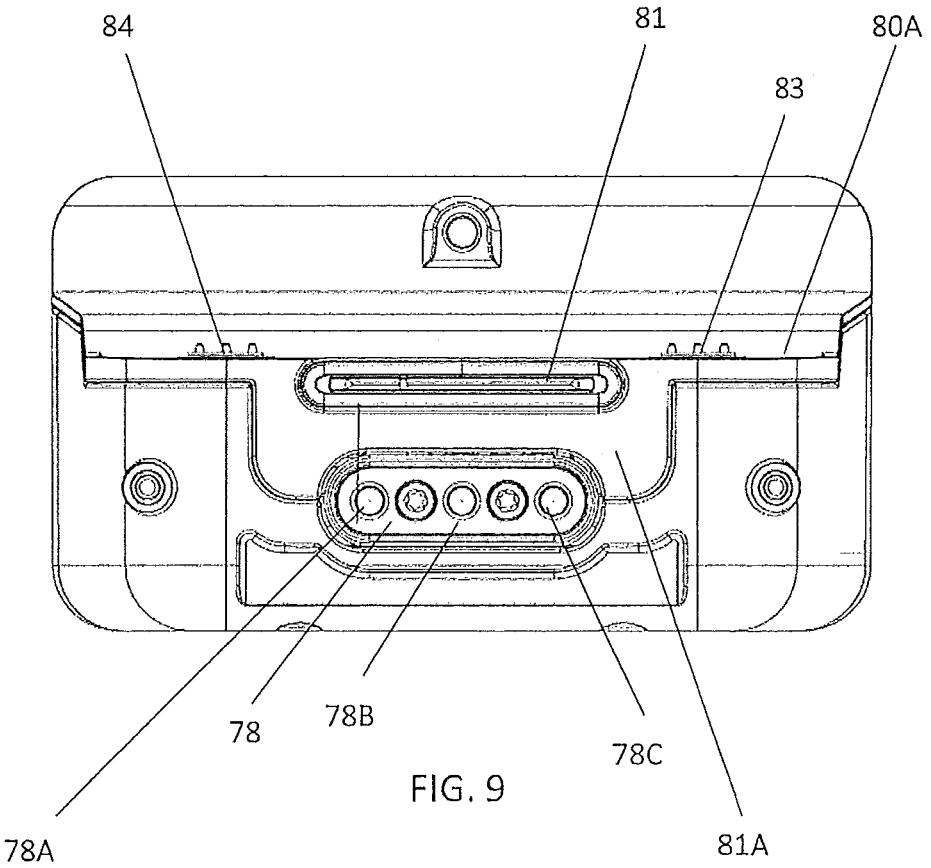
FIG. 9 is a perspective view of the side of the service module shown in FIG. 3.

The upper portion 101 of body 45 includes three fluid ports 120, 121, 122 disposed adjacent slit 81 in face 81A. Each fluid port 120, 121, 122 is arranged to connect to a fluid pathway within the inkjet printer 1 to allow fluid to flow between one of the plurality of fluid conduits 46 within body 45 and the fluid pathway. In particular, port 120 may connect to supply line 44, port 121 may connect to line 62 and port 122 may connect to flush line 54 (see FIG. 2). This connection is via pin connector 78 which includes pins 78A, 78B, and 78C, which pins extend out from face 81A (see FIG. 9). Pin connector 78 is attached to the three fluid ports 120, 121, 122 of the upper portion 101 of body 45 via screws 123. An o-ring seal 124 is provided between each fluid port 120, 121, 122 and a corresponding pin of pin connector 78.

Each of the two valve bodies 74, 75 is preferably attached to the upper portion 101 of the body 45. Each of the valve bodies 74, 75 are preferably of the same general type: a dual coil solenoid-operated two-way control valves. The common ports of the two valves are connected such that the two valve bodies 74, 75 (each with two independently moveable coils) provide four valves 48, 49, 50, 51 with the functionality as described above with reference to FIG. 2.

A body 125 of pressure relief valve 56 is integrally formed on an upper surface of upper portion 101 of body 45. Two apertures 126, 127 connect the body 125 of pressure relief valve 56 to the lower surface 115 of the upper portion 101 of body 45. In use apertures 126, 127 are aligned with apertures 111, 113 respectively. The pressure relief valve 56 further includes a valve seat 128 and a valve cover 129, the valve cover 129 being connected to the upper portion 101 of the body 45 via three screws 130.

Once assembled, each of the two septum needles 76, 77 is received within one of the generally circular apertures 80 of the upper portion 71 of the housing and provides a fluid connector for engaging an outlet of a fluid cartridge to allow fluid to flow from the engaged cartridge to one of the plurality of fluid conduits of body 45.

Together, the three fluid ports 120, 121, 122 and card edge connector 85 form the printer connection 11 for releasable engagement with an inkjet printer (with fluid ports 120, 121, 122 providing the plurality of fluid ports and card edge connector 85 providing the electrical connector). The fluid ports 120, 121, 122 are accessible via an aperture formed in housing by corresponding cut away sections of the upper and lower portions 71, 72. Furthermore, card edge connector 85 is accessible via slit 81 in surface 81A. Therefore, the printer connections 11 is exposed by the housing 71, 72 to allow for connection to printer 1.

The septum needle assemblies 76, 77 and apertures 80 of fluid connector are preferably disposed on or adjacent the surface 80A of the removable module. The electrical connectors 83, 84 and apertures 79 of are preferably disposed adjacent the fluid connectors on the surface 80A. The electrical connector 85 and slit 81, and the pins 78A, 78B, and 78C which are connected to the plurality of fluid ports 120, 121, 122 are disposed on or adjacent surface 81A of the removable module. Surface 80A is preferably oriented generally perpendicular to surface 81A. Thus, the configuration of the fluid and electrical connections on the module allows easy replacement of the module within the printer and easy connection of ink/solvent containers to the module.

Thus, it can be seen that service module 6 provides an interface between the inkjet printer 1 and each of ink and solvent cartridges 8, 10. Since the printer connection 11 provides for releasable engagement with an inkjet printer the service module 6 can be easily removed from the inkjet printer 1 for servicing or replacement. This is advantageous because during operation of the inkjet printer 1, one or more of the plurality of conduits 46, valves 48, 49, 50, 51 and flush pump 47 may become blocked or damaged, or the gas sensor 87 may reach the end of its useful life. In such case, the service module 6 can be easily replaced.

While specific embodiments of the invention have been described above, it will be appreciated that the invention may be practiced otherwise than as described. The description is not intended to limit the invention.

The invention claimed is:

1. A removable module for an inkjet printer comprising a printhead and an ink supply system for supplying a mixture of ink and solvent to the printhead, the removable module comprising:

a housing;

a plurality of fluid conduits disposed within the housing;

two cartridge connections, each for releasable engagement with a fluid cartridge, each cartridge connection being exposed by the housing and comprising: a fluid connector for engaging an outlet of a fluid cartridge to allow fluid to flow from the engaged cartridge to one of the plurality of fluid conduits; and an electrical contact arranged to contact a corresponding electrical contact on the engaged fluid cartridge;

a printer connection for releasable engagement with the inkjet printer, the printer connection being exposed by the housing and comprising: a plurality of fluid ports, each fluid port arranged to connect to a fluid pathway within the inkjet supply system to allow fluid to flow between one or more of the plurality of fluid conduits and the fluid pathway; and an electrical connector arranged to engage with a corresponding connector on the inkjet printer; and an electrical link between the electrical connector of the printer connection and the electrical contact of each of the two cartridge connections, the electrical link being disposed within the housing; and, wherein said removable module is adapted to be releasably engaged with said ink supply system.

2. The removable module of claim 1, wherein the housing is provided with one or more apertures in the vicinity of each of the cartridge connections and the printer connection.

3. The removable module of claim 1 further comprising a pump arranged to draw fluid from the fluid connector or one or both of the fluid connectors to one or more of the plurality of fluid ports of the printer connection.

4. The removable module of claim 3 further comprising an electrical link between the electrical connector of the printer connection and the pump.

5. The removable module of claim 3 further comprising a pressure relief valve connected across an inlet port and an outlet port of the pump.

6. The removable module of claim 1 further comprising a body disposed within the housing and wherein the body defines the plurality of fluid conduits.

7. The removable module of claim 6, wherein the body comprises two portions and a seal, the two portions being connected together with the seal disposed therebetween.

8. The removable module of claim 7, wherein at least one of the two portions is provided with one or more grooves and at least one of the plurality of conduits is formed by the one or more grooves when the two portions are connected together.

9. The removable module of claim 1 wherein the fluid connector of each of the cartridge connections comprises a septum needle disposed within a generally cylindrical bore in the housing.

10. The removable module of claim 1 further comprising a plurality of valves disposed within the housing and arranged to selectively link two or more of the plurality of fluid conduits so as to form one or more fluid pathways through the housing.

11. The removable module of claim 1 wherein the fluid connector or a portion thereof is disposed on a first surface of the removable module and the electrical contact or a portion thereof is disposed adjacent the fluid connector on the first surface of the removable module, and the plurality of fluid ports or a portion thereof are disposed on a second surface of the removable module, and the electrical connector or a portion thereof is disposed on a second surface of the removable module.

12. The removable module of claim 1 further comprising a data storage device disposed on the module and an electrical link between the electrical connector of the printer connection and the data storage device, the data storage device configured for transferring data to a controller of the printer.

13. The removable module of claim 1 wherein the removable module does not include an ink reservoir or a filter.

14. The ink jet printer of claim 1 wherein one of the cartridge connections is adapted for releasable engagement with an ink cartridge and the other cartridge connection is adapted for releasable engagement with a solvent cartridge, the ink jet printer further comprising:

a cabinet; an ink storage system disposed within the cabinet, the ink storage system comprising an ink reservoir in fluid communication with the removable module and a filter in fluid communication with the ink reservoir; a print head disposed externally of the cabinet and operable to receive ink from the ink reservoir and to project it, as a stream of drops, onto a substrate; and a controller operable to provide control signals to the removable module, the ink storage system and the print head so as to control the flow of ink and solvent through the inkjet printer.

15. The ink jet printer of claim 14 wherein the controller is operable to provide control signals to control a flow of ink and/or solvent from the two cartridge connections to the ink storage system.

16. The ink jet printer of claim 14 wherein the controller is operable to provide control signals to control a flow of solvent from one of the two cartridge connections to the print head.

17. Apparatus for inkjet printing using a solvent based ink, the Apparatus comprising:

an inkjet printer comprising a printhead and an ink supply system, the ink supply system comprising a removable module adapted to be releasably engaged with the ink supply system and being operable to supply solvent based ink to the printhead;

a cabinet for housing the ink supply system and the removable module, and wherein said printhead is disposed externally of the cabinet;

a gas sensor disposed within the removable module in the cabinet and operable to sense solvent vapor within the cabinet; and a controller configured to receive a signal the gas sensor and output a signal based thereon.

18. The ink jet printer of claim 17, wherein the controller outputs an alarm signal based upon sensed solvent vapor.

19. The ink jet printer of claim 18, wherein the gas sensor outputs a signal indicating a concentration of solvent vapor in the cabinet.

20. The ink jet printer of claim 17, wherein the gas sensor is disposed in a lower portion of the cabinet.

* * * * *